US010662799B2

(12) United States Patent
Wusatowska-Sarnek

(10) Patent No.: US 10,662,799 B2
(45) Date of Patent: May 26, 2020

(54) WEAR RESISTANT AIRFOIL TIP

(71) Applicant: United Technologies Corporation, Farmington, CT (US)

(72) Inventor: Agnieszka M. Wusatowska-Sarnek, Mansfield Ctr., CT (US)

(73) Assignee: RAYTHEON TECHNOLOGIES CORPORATION, Farminton, CT (US)

( * ) Notice: Subject to any disclaimer, the term of this patent is extended or adjusted under 35 U.S.C. 154(b) by 0 days.

(21) Appl. No.: 15/887,494

(22) Filed: Feb. 2, 2018

(65) Prior Publication Data

US 2019/0242267 A1 Aug. 8, 2019

(51) Int. Cl.

| | |
|---|---|
| ***F01D 11/12*** | (2006.01) |
| ***F01D 5/28*** | (2006.01) |
| ***F01D 11/00*** | (2006.01) |
| ***C23C 8/68*** | (2006.01) |
| ***F01D 25/00*** | (2006.01) |

(52) U.S. Cl.

CPC ..... *F01D 11/122* (2013.01); *C23C 8/68* (2013.01); *F01D 5/288* (2013.01); *F01D 11/001* (2013.01); *F01D 25/005* (2013.01); *F05D 2220/32* (2013.01); *F05D 2230/90* (2013.01); *F05D 2300/131* (2013.01); *F05D 2300/134* (2013.01); *F05D 2300/174* (2013.01); *F05D 2300/506* (2013.01); *F05D 2300/611* (2013.01)

(58) Field of Classification Search

CPC ..... F01D 11/122; F01D 5/288; F01D 25/005; F05D 2220/32; F05D 2230/90; F05D 2300/611

USPC ..... 415/173.4

See application file for complete search history.

(56) References Cited

U.S. PATENT DOCUMENTS

| | | | |
|---|---|---|---|
| 4,689,242 | A | 8/1987 | Pike |
| 4,741,973 | A | 5/1988 | Condit et al. |
| 5,514,482 | A | 5/1996 | Strangman |
| 6,060,174 | A | 5/2000 | Sabol et al. |
| 7,510,370 | B2 | 3/2009 | Strangman et al. |

(Continued)

FOREIGN PATENT DOCUMENTS

| | | | |
|---|---|---|---|
| EP | 3029113 | A1 | 6/2016 |
| EP | 3081757 | A2 | 10/2016 |
| WO | 8500837 | A1 | 2/1985 |

OTHER PUBLICATIONS

European Search Report for European Application No. 19154707.4 dated Jun. 3, 2019, 8 pages.

(Continued)

*Primary Examiner* — Dwayne J White
*Assistant Examiner* — Danielle M. Christensen
(74) *Attorney, Agent, or Firm* — Cantor Colburn LLP

(57) ABSTRACT

A gas turbine engine includes an engine static structure extending circumferentially about an engine centerline axis; a compressor section, a combustor section, and a turbine section within the engine static structure. At least one of the compressor section and the turbine section includes at least one airfoil and at least one seal member adjacent to the at least one airfoil. A tip of the at least one airfoil is metal having a wear resistant coating and the at least one seal member is coated with an abradable coating. The wear resistant coating is formed as a layer in a base metal surface of the airfoil, has a thickness less than or equal to 10 mils (254 micrometers) and includes metal boride compounds.

11 Claims, 3 Drawing Sheets

(56) References Cited

U.S. PATENT DOCUMENTS

| | | | | |
|---|---|---|---|---|
| 9,341,066 | B2 | 5/2016 | Bintz et al. | |
| 9,431,066 | B1 | 8/2016 | Chen et al. | |
| 2006/0057017 | A1* | 3/2006 | Woodfield | B22F 9/20 419/66 |
| 2010/0284797 | A1* | 11/2010 | Jarrabet | F01D 11/122 415/174.4 |
| 2013/0108463 | A1 | 5/2013 | Hathiwala et al. | |
| 2015/0267544 | A1 | 9/2015 | Gurt Santanach et al. | |
| 2015/0308276 | A1 | 10/2015 | Kleinow et al. | |
| 2017/0101348 | A1 | 4/2017 | Wan et al. | |
| 2019/0242261 | A1 | 8/2019 | Wusatowska-Sarnek | |

OTHER PUBLICATIONS

European Search Report for European Application No. 19154827.0 dated Jun. 14, 2019, 10 pages.

* cited by examiner

WEAR RESISTANT AIRFOIL TIP

BACKGROUND

Exemplary embodiments pertain to the art of wear resistant airfoil tips. Compressor stages in a turbine engine have one or more rows of rotating blades surrounded by the casing. To maximize engine efficiency, leakage of gas between the airfoil tips and casing should be minimized. This may be achieved by configuring the airfoil tips and casing seal such that they contact each other during periods of operation. With such a configuration, the airfoil tips act as an abrading component and the seal can be provided as an abradable seal. Previously the blade tip has comprised an abrasive material such a cubic boron nitride. The process to apply the abrasive material is costly and time consuming, particularly when the airfoil tips are reconditioned.

BRIEF DESCRIPTION

Disclosed is a gas turbine engine including: an engine static structure extending circumferentially about an engine centerline axis; a compressor section, a combustor section, and a turbine section within the engine static structure; wherein at least one of the compressor section and the turbine section includes at least one airfoil and at least one seal member adjacent to the at least one airfoil, wherein a tip of the at least one airfoil is metal having a wear resistant coating and the at least one seal member is coated with an abradable coating, wherein wear resistant coating has a thickness less than or equal to 10 mils (254 micrometers) and includes metal boride compounds.

In addition to one or more of the features described above, or as an alternative to any of the foregoing embodiments, the wear resistant coating is formed in a base metal surface of the airfoil and the metal boride compounds include $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant coating has a hardness of 1500 to 2500 HV 0.05 g.

In addition to one or more of the features described above, or as an alternative to any of the foregoing embodiments, the airfoil includes aluminum, aluminum alloy, titanium, titanium alloy, steel and steel alloy, nickel, nickel alloy, or a combination thereof.

Also disclosed is a method of forming a seal between at least one airfoil and at least one seal member, the method including: forming a wear resistant coating on the tip of the at least one airfoil; and coating the at least one seal member with an abradable coating, wherein the wear resistant coating includes metal boride compounds and has a thickness less than or equal to 254 micrometers.

In addition to one or more of the features described above, or as an alternative to any of the foregoing embodiments, the wear resistant coating is formed in a base metal surface of the airfoil and the metal boride compounds comprise $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant coating has a hardness of 1500 to 2500 HV 0.05 g.

In addition to one or more of the features described above, or as an alternative to any of the foregoing embodiments, the airfoil comprises aluminum, aluminum alloy, titanium, titanium alloy, steel and steel alloy, nickel, nickel alloy, or a combination thereof.

In addition to one or more of the features described above, or as an alternative to any of the foregoing embodiments, the wear resistant coating is formed in a base metal surface of the airfoil by gaseous boronizing, liquid boronizing, powder boronizing, paste boronizing, chemical vapor deposition, plasma-assisted chemical vapor deposition, plasma vapor deposition, electron-beam plasma vapor deposition, glow discharge or a combination thereof.

In addition to one or more of the features described above, or as an alternative to any of the foregoing embodiments, wherein the wear resistant coating is formed by surrounding the airfoil with a source of metal atoms followed by surrounding the airfoil with a source of boron atoms.

Also disclosed is a coating on the tip of at least one metal airfoil adjacent to at least one seal member having an abradable coating wherein the coating includes metal boride compounds and the coating has a thickness less than or equal to 254 micrometers.

In addition to one or more of the features described above, or as an alternative to any of the foregoing embodiments, the wear resistant coating is formed in a base metal surface of the airfoil and metal boride compounds comprise $M_3B_4$ and M can be titanium, vanadium, chromium, zirconium, niobium, molybdenum, tantalum, tungsten, or a combination thereof.

In addition to one or more of the features described above, or as an alternative to any of the foregoing embodiments, the wear resistant coating has a hardness of 1500 to 2500 HV 0.05 g.

In addition to one or more of the features described above, or as an alternative to any of the foregoing embodiments, the airfoil comprises aluminum, aluminum alloy, titanium, titanium alloy, steel and steel alloy, nickel, nickel alloy, or a combination thereof.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
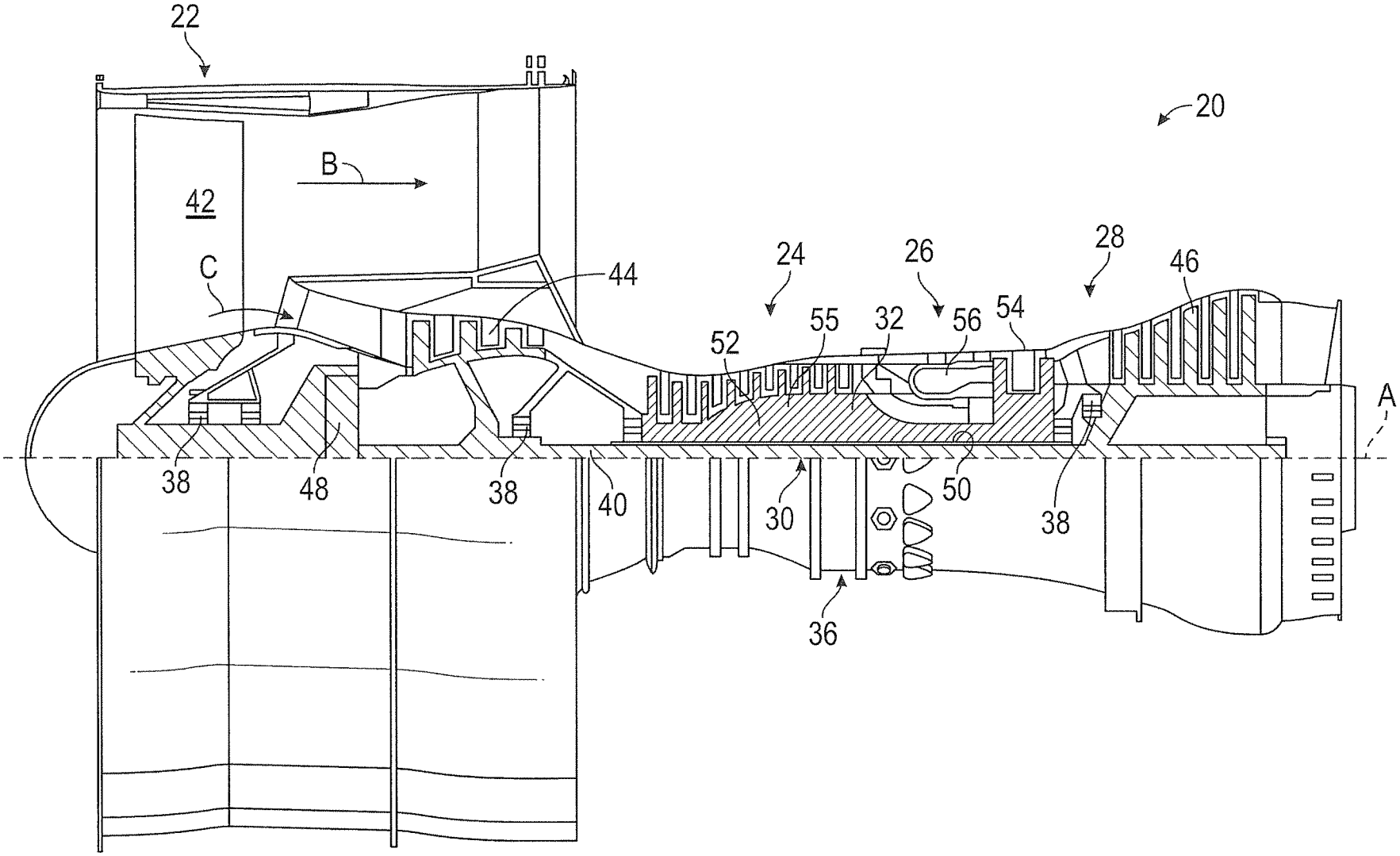
FIG. 1 is a cross-sectional view of a gas turbine engine

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. The high pressure compressor 52 includes rotor assembly 55. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
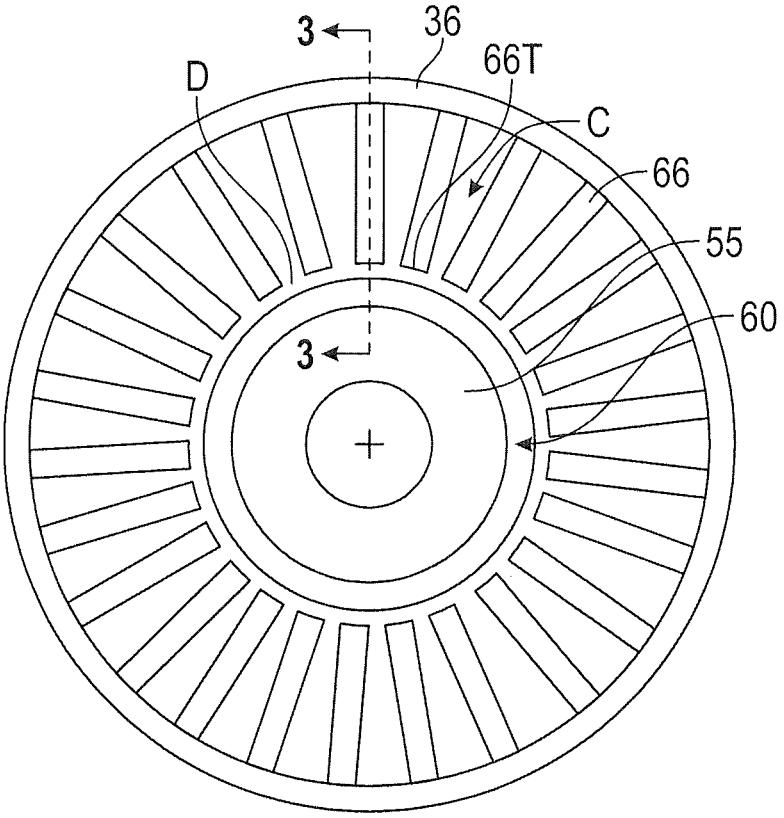
FIG. 2 is a cross-sectional view illustrating the relationship of the rotor and vanes.
Figure 3:
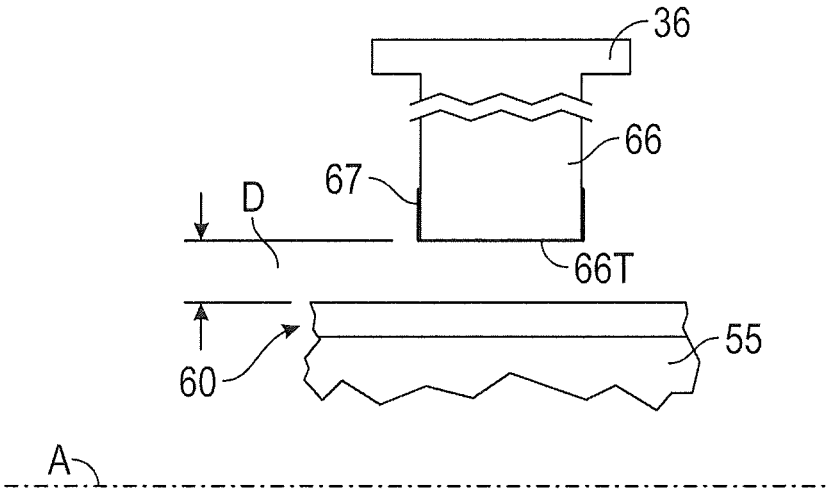
FIG. 3 is a cross-sectional view taken along the line 3-3 of FIG. 2.
Figure 4:
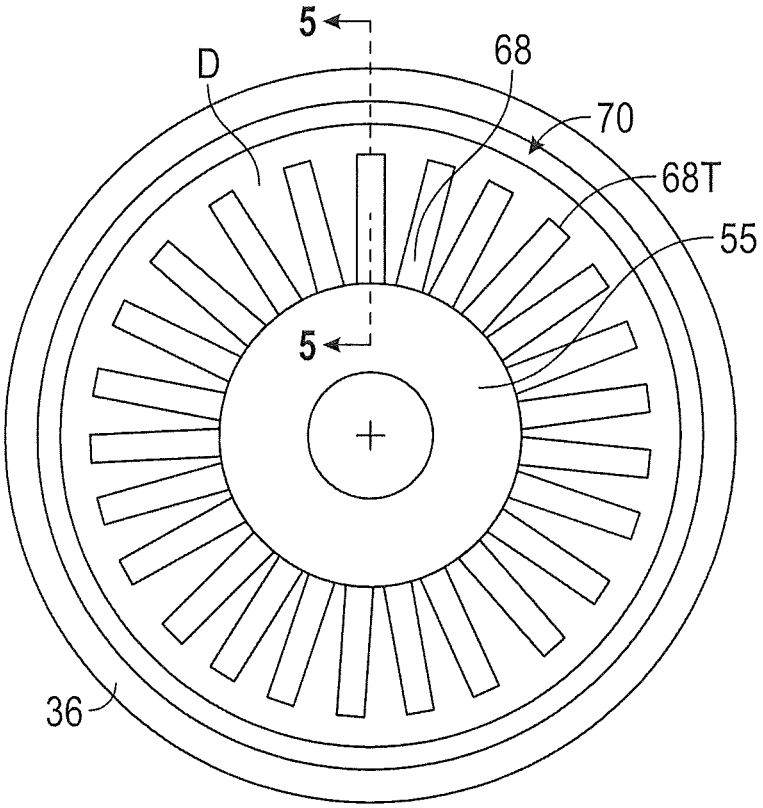
FIG. 4 is a cross-sectional view illustrating the relationship of engine static structure and blades.
Figure 5:
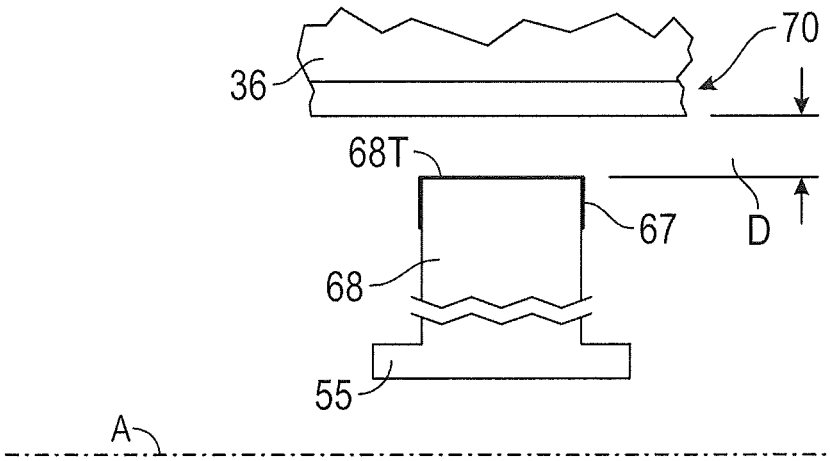
FIG. 5 is a cross-sectional view taken along the line 5-5 of FIG. 4.

The term "airfoil" is intended to cover both rotor blades and stator vanes. FIG. 2 and FIG. 3 show the interaction of a stator vane with a rotor. FIG. 4 and FIG. 5 disclose the invention with respect to interaction of a rotor blade with a casing or shroud. The coating described herein may be used with either or both configurations.

FIG. 2 is a cross section of compressor section 44 of FIG. 1. FIG. 2 shows an engine static structure 36 which has a rotor assembly 55 inside. Vanes 66 are attached to engine static structure 36 and the gas path C is shown as the space between vanes 66. Abradable coating 60, is on rotor assembly 55 such that the clearance D between coating 60 and non-abrasive vane tips 66T of vanes 66 with wear resistant coating 67 (shown in FIG. 3) has the proper tolerance for operation of the engine, e.g., to serve as a seal to prevent leakage of air (thus increasing efficiency), while not interfering with relative movement of the vanes and rotor assembly. In FIGS. 2 and 3, clearance D is expanded for purposes of illustration. In practice, clearance D may be, for example, in a range of about 25 to 55 mils (635 to 1397 microns) when the engine is cold and 0 to 35 mils (0 to 889 microns) during engine operation depending on the specific operating condition and previous rub events that may have occurred.

FIG. 3 shows the cross section along line 3-3 of FIG. 2, with engine static structure 36 and vane 66. Coating 60 is attached to rotor assembly 55, with a clearance D between coating 60 and vane tip 66T of vane 66 with wear resistant coating 67 that varies with operating conditions, as described herein. Coating 60 is an abradable coating. Coating 67, described in detail below, is a wear resistant coating that is very smooth and has hardness at least an order to two orders of magnitude higher than the vane parent metal as well as the abradable coating. In operation, the wear resistant coating has superior cutting ability to abrade the coating 60 and eliminates metal transfer from the vane tip to the abradable coating during sliding contact wear.

As can be seen from FIG. 4 and FIG. 5, the same concept is used in which coating 70 is provided on the inner diameter surface of engine static structure 36 and wear resistant coating 67 is provided on tip 68T of blade 68. Coating 70 is an abradable coating. Coating 67, described in detail below, is a wear resistant coating that is very smooth and has hardness at least an order to two orders of magnitude higher than the blade parent metal as well as the abradable coating. In operation, the wear resistant coating has superior cutting ability to abrade the coating 70 and eliminates metal transfer from the blade tip to the abradable coating during sliding contact wear.

The airfoil (the vane and blade) may be made from a range of materials such as aluminum, aluminum alloy, titanium, titanium alloy, steel and steel alloy, nickel, nickel alloy or a combination thereof. Because the wear resistant coating is made by boronizing the blade or vane itself (as described below), the rotor can be bladed or the rotor and the blades may be formed together.

The wear resistant coating is formed in the base metal surface of the airfoil and includes metal boride compounds. It is expressly contemplated that the wear resistant compound may include more than one metal boride compounds. Exemplary metal boride compounds include $M_3B_4$ (M=Ti, V, Cr, Zr, Nb, Mo, Ta, W, or a combination thereof) as well as simpler borides and diborides such as MB and $MB_2$. The specific composition of the coating will vary depending on the specific application and its requirements for sustaining rub interaction between the airfoil tip and the abradable seal as well as the abradable seal material properties. The wear resistant coating will improve the cutting ability of the airfoil through the abradable coating and eliminate the metal transfer from the tip to the rubbed coating. The wear resistant coating has a micro-hardness of 1500 to 2500 HV 0.05 g.

The wear resistant coating is formed by boronizing the airfoil. Boronizing is a diffusion process that saturates the substrate's surface with boron at an elevated temperature. In some embodiments boronizing includes surrounding the airfoil with a source of metal atoms (M) and a source of boron atoms (B). The metal atoms diffuse into the airfoil surface to locally enrich the chemical composition with an excess of M and combine with the boron to form the metal boride compounds such as $M_3B_4$ within the airfoil. In some embodiments, the source of metal atoms surrounds the airfoil first and then the source of boron atoms is provided. The use of an additional source of metal atoms promotes formation of metal borides comprising a metal that is either not a component of the airfoil alloy or is not present in excess in the composition of the airfoil alloy. Exemplary methods include gaseous boronizing which uses gaseous bonding agents (diborane, boron halides, and organic boron compounds), liquid boronizing which uses liquid bonding agents such as borax melts, optionally with viscosity-reducing additives. Gaseous and liquid boronizing can be performed with or without the use of electric current. Other boronizing methods include powder or paste-pack bonding using slurry suspensions. An additional metal source may be provided as a nanoparticulate suspension. The synthesis of the boron-based coating can be also conducted by chemical vapor deposition (CVD), plasma-assisted CVD, reactive electron-beam evaporation such as plasma vapor deposition (PVD) or electron beam PVD, glow discharge or a combination thereof. Vapor deposition methods may use multiple targets to provide an additional metal source. Exemplary temperatures employed for boronizing are 500 degrees C. to 1150 degrees C.

With respect to the wear resistant coating, metal boride compounds are formed in the base metal's surface and subsurface with a layer depth of 254 microns or less. These phases are very hard phases that will resist wear and improve cutting ability of the airfoil tip. Borides also have low friction and low surface energy, so they will also resist the coating material transfer to the airfoil tips.

The thickness of the wear resistant coating may be greater than or equal to 5 microns.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A gas turbine engine comprising: an engine static structure extending circumferentially about an engine centerline axis; compressor section, a combustor section, and a turbine section within the engine static structure; wherein at least one of the compressor section and the turbine section comprises at least one airfoil and at least one seal member adjacent to the at least one airfoil, wherein a tip of the at least one airfoil is metal having a wear resistant coating and the at least one seal member is coated with an abradable coating, wherein the wear resistant coating has a thickness less than or equal to 10 mils (254 micrometers) and further wherein the wear resistant coating comprises metal boride compounds, is formed in a base metal surface of the airfoil and the metal boride compounds comprise $M_3B_4$ and M is titanium, vanadium, chromium, zirconium, niobium, molybdenum, tantalum, tungsten, or a combination thereof.

2. The gas turbine of claim 1, wherein the wear resistant coating has a hardness of 1500 to 2500 HV 0.05 g.

3. The gas turbine of claim 1, wherein the airfoil comprises aluminum, aluminum alloy, titanium, titanium alloy, steel and steel alloy, nickel, nickel alloy, or a combination thereof.

4. A method of forming a seal between at least one airfoil and at least one seal member, the method comprising: forming a wear resistant coating on the tip of the at least one airfoil; and coating the at least one seal member with an abradable coating, wherein the wear resistant coating comprises metal boride compounds, is formed in a base metal surface of the airfoil, has a thickness less than or equal to 254 micrometers, and the metal boride compounds comprise $M_3B_4$ and M is titanium, vanadium, chromium, zirconium, niobium, molybdenum, tantalum, tungsten, or a combination thereof.

5. The method of claim 4, wherein the wear resistant coating has a hardness of 1500 to 2500 HV 0.05 g.

6. The method of claim 4, wherein the airfoil comprises aluminum, aluminum alloy, titanium, titanium alloy, steel and steel alloy, nickel, nickel alloy, or a combination thereof.

7. The method of claim 4, wherein the wear resistant coating is formed in a base metal surface of the airfoil by gaseous boronizing, liquid boronizing, powder boronizing, paste boronizing, chemical vapor deposition, plasma-assisted chemical vapor deposition, plasma vapor deposition, electron-beam plasma vapor deposition, glow discharge or a combination thereof.

8. The method of claim 4, wherein the wear resistant coating is formed by surrounding the airfoil with a source of metal atoms followed by surrounding the airfoil with a source of boron atoms.

9. A coating on the tip of at least one metal airfoil adjacent to at least one seal member having an abradable coating, wherein the wear resistant coating is formed in a base metal surface of the airfoil, the coating has a thickness less than or equal to 254 micrometers, the coating comprises metal boride compounds and the metal boride compounds comprise $M_3B_4$ and M is titanium, vanadium, chromium, zirconium, niobium, molybdenum, tantalum, tungsten, or a combination thereof.

10. The coating of claim 9, wherein the wear resistant coating has a hardness of 1500 to 2500 HV 0.05 g.

11. The coating of claim 9, wherein the airfoil comprises aluminum, aluminum alloy, titanium, titanium alloy, steel and steel alloy, nickel, nickel alloy, or a combination thereof.

* * * * *